US008581659B2

(12) United States Patent
Ulbrich et al.

(10) Patent No.: US 8,581,659 B2
(45) Date of Patent: Nov. 12, 2013

(54) CURRENT CONTROLLED CURRENT SOURCE, AND METHODS OF CONTROLLING A CURRENT SOURCE AND/OR REGULATING A CIRCUIT

(75) Inventors: Steven Ulbrich, Anaheim, CA (US); Kenneth Kwok, Irvine, CA (US); Jan Krellner, Laguna Niguel, CA (US); Joon Park, Irvine, CA (US)

(73) Assignee: Dongbu Hitek Co., Ltd., Seoul (KR)

( * ) Notice: Subject to any disclaimer, the term of this patent is extended or adjusted under 35 U.S.C. 154(b) by 717 days.

(21) Appl. No.: 12/693,407

(22) Filed: Jan. 25, 2010

(65) Prior Publication Data

US 2011/0181256 A1 Jul. 28, 2011

(51) Int. Cl.
*G05F 1/10* (2006.01)

(52) U.S. Cl.
USPC ..... 327/540; 307/362; 323/312

(58) Field of Classification Search
USPC ..... 363/16–20, 21.021, 12, 21.16, 21.05; 323/311–316, 275, 280, 285; 327/103, 327/536, 540, 541, 560, 355, 561, 512; 330/282, 288, 254, 257
See application file for complete search history.

(56) References Cited

U.S. PATENT DOCUMENTS

| | | | | |
|---|---|---|---|---|
| 4,195,235 | A * | 3/1980 | Schoeff | 327/103 |
| 4,642,551 | A * | 2/1987 | Miller | 323/314 |
| 4,885,674 | A * | 12/1989 | Varga et al. | 363/21.09 |
| 5,012,401 | A * | 4/1991 | Barlage | 363/97 |
| 5,045,773 | A * | 9/1991 | Westwick et al. | 323/316 |
| 5,245,526 | A * | 9/1993 | Balakrishnan et al. | 363/97 |
| 6,229,389 | B1 * | 5/2001 | Pullen et al. | 330/10 |
| 6,255,897 | B1 * | 7/2001 | Klemmer | 327/538 |
| 6,509,722 | B2 * | 1/2003 | Lopata | 323/280 |
| 6,836,148 | B2 * | 12/2004 | Pullen et al. | 326/81 |
| 7,355,375 | B2 * | 4/2008 | Xi | 323/282 |
| 7,535,208 | B2 * | 5/2009 | De Cremoux | 323/280 |
| 7,821,328 | B2 * | 10/2010 | Hoque et al. | 327/536 |
| 2004/0195235 | A1 | 10/2004 | Kim et al. | |

OTHER PUBLICATIONS

"1.6MHz Low Quiescent Current High Efficiency Synchronous Buck Regulator"; ISL9106; Jun. 29, 2007; pp. 1-13; Intersil Americas Inc.
"CMOS Micropower Inverting Switching Regulator"; MAX634/MAX4391; May 1986; pp. 1-12; Maxim Integrated Products, Sunnyvale, CA.
"Digitally Adjustable LCD Bias Supplies"; MAX1620/MAX1621; Jan. 1998; pp. 1-20; Maxim Integrated Products.

(Continued)

*Primary Examiner* — Rajnikant Patel
(74) *Attorney, Agent, or Firm* — Murabito, Hao & Barnes LLP; Andrew D. Fortney

(57) ABSTRACT

Current sources, systems including the current source, and methods for regulating and/or controlling a circuit using the current source. The current source is generally configured to (i) receive a reference current, a bias voltage and a feedback/input current and (ii) provide an output current. The systems generally include the current source, a circuit directly or indirectly receiving the output current, a bias source/generator configured to provide the bias voltage, and a current reference configured to sink or source a predetermined amount of current from or to the output current. The method generally includes (a) applying a bias voltage to the current source, the current source receiving an input current and providing an output current; (b) sinking or sourcing a reference current from or to the output current; (c) applying the output of the current source directly or indirectly to a regulated circuit; and (d) providing the input current from the regulated circuit.

20 Claims, 4 Drawing Sheets

(56) References Cited

OTHER PUBLICATIONS

"80V, 300mW Boost Converter and Current Monitor for APD Bias Applications"; MAX15031; Jun. 2009; pp. 1-17; Maxim Integrated Products.

"Low-Cost, 3A, 4.5V to 28V Input, 350kHz, PWM Step-Down DC-DC Regulator with Internal Switches"; MAX15041; Jul. 2009; pp. 1-16; Maxim Integrated Products.

"Basic Switching-Regulator-Layout Techniques"; Application Note 2997; Jan. 15, 2004; pp. 1-8; Maxim Integrated Products; www. maxim-ic.com/an2997.

"Switch Allows Low-Voltage Regulator to Start Under Load"; Application Note 951; Jul. 9, 1998; pp. 1-2; Maxim Integrated Products; www. maxim-ic.com/an951.

* cited by examiner

CURRENT CONTROLLED CURRENT SOURCE, AND METHODS OF CONTROLLING A CURRENT SOURCE AND/OR REGULATING A CIRCUIT

FIELD OF THE INVENTION

The present invention generally relates to the field of analog integrated circuit designs. More specifically, embodiments of the present invention pertain to current sources and methods for regulating and/or controlling a circuit using a current source.

DISCUSSION OF THE BACKGROUND

A feedback loop in a conventional regulator system typically uses voltage feedback and a resistive voltage divider to set the regulated output voltage relative to an input reference voltage. The difference of these two signals (i.e., the regulated output voltage and the reference voltage) is usually obtained by standard connections in an operational amplifier ("op amp"), differential amplifier, or transconductance amplifier, which operate on the voltage signals.

FIG. 1 shows a conventional op amp- or differential amp-based voltage regulator 10. A voltage divider 30 (comprising first and second resistors 32 and 34 in series between a regulated voltage $V_{OUT}$ and a ground potential 36) provides a first input into the op amp/differential amp 20. A conventional bias source 40 (e.g., a conventional bias voltage generator) provides a second input (i.e., a reference voltage $V_{REF}$) into the op amp/differential amp 20. The difference ΔV between the two input signals is output to the signal path having a node at which the voltage ($V_{OUT}$) is regulated, thereby providing a feedback path to the voltage-controlled voltage source 10.

In the example shown in FIG. 1, the ground potential 36 in the voltage divider 30 is a system potential, whereas the ground potential 42 for the voltage source 40 is a reference ground. The different ground potentials may have different values due to different noise effects (e.g., from the system vs. on the chip). As a result, when the feedback loop is closed, the regulated voltage $V_{OUT}$ has a value that can be defined according to the following Equation (1):

$$V_{OUT}=(V_{REF}\pm\Delta GND)(1+(R2/R1)) \quad (1)$$

where ΔGND is the voltage difference between the different ground potentials 36 and 42, R1 is the resistance of resistor 32, and R2 is the resistance of resistor 34.

In a relatively high-gain, high-power system, R2/R1>>1, and $$V_{OUT}=(V_{REF}\cdot(R2/R1))\pm(\Delta GND\cdot(R2/R1)) \quad (2)$$

In such a system, the sensitivity of the regulated voltage $V_{OUT}$ to ground noise is:

$$dV_{OUT}/d\Delta GND=R2/R1 \quad (3)$$

In many systems, it is difficult to maintain a solid ground reference between the output voltage and reference voltage. For example, in a white LED (WLED) backlighting system, the DC ground reference for the output voltage in a boost regulator IC is external to the IC, whereas the voltage reference signal is internal. This creates noise susceptibility and, in a high power system, erratic regulator behavior, particularly if the ratio of the output voltage to the reference voltage is large. In many boost converter applications, the output voltage to reference voltage ratio can be as high as 40:1. This means a ground noise level of 100 mV shows up on the regulated output multiplied by 40× (i.e., 4V).

FIG. 2 shows a voltage-controlled transconductance control circuit 10'. When the input $V_{OUT}$ is part of a feedback loop from a node in the signal path being controlled, the control circuit 10' and the feedback loop together may be considered to be a regulator. The transconductance control circuit 10' includes a transconductance amplifier 20', and operates similarly to the op amp-based regulator 10 of FIG. 1, except that the output current ΔI from the transconductance amplifier 20' controls or biases a current source 50, which outputs a current $I_{OUT}$ having a value equal to the gain of the transconductance amplifier 20' times the voltage $V_{FB}$ from the voltage divider 30. However, the value of voltage $V_{OUT}$ is still defined according to Equation (1) above. As a result, variations in the different ground potentials can cause significant variations in the regulated current output from the transconductance control circuit 10'.

SUMMARY OF THE INVENTION

Embodiments of the present invention relate to circuits and methods for regulating and/or controlling a circuit using a current source. In one aspect (e.g., "closed loop" embodiments), the circuit generally includes a current source configured to receive a reference current, a bias voltage and a feedback current, the current source providing an output current; a regulated circuit, directly or indirectly receiving the output current and directly or indirectly providing the feedback current; and a current reference, configured to sink a predetermined amount of current from the output current or source a predetermined amount of current to the output current. The method generally includes (a) applying a bias voltage to the current source, the current source receiving an input current and providing an output current; (b) sinking or sourcing a reference current from or to the output current, wherein the output current represents a difference between the input current and the reference current; and (c) applying the output current directly or indirectly to a regulated circuit.

Another aspect of the invention involves a circuit that includes a bias source and/or generator configured to provide a bias voltage; a current reference configured to sink or source a predetermined amount of current; and a current source (e.g., a current-controlled current source) configured to receive the predetermined amount of current, the bias voltage and an input current, the current source providing an output current representing a difference between the input current and the predetermined amount of current. In some embodiments, the current source includes a transistor having a first terminal receiving the input current, a second terminal providing the output current, and a control terminal receiving the bias voltage.

Yet another aspect of the invention (e.g., "open loop" embodiments) involves a circuit that includes a current controlled current source configured to receive a bias voltage and an input current, the current controlled current source providing an output current; a circuit configured to receive the output current; a bias source and/or generator configured to provide the bias voltage; and a current reference, configured to sink or source a predetermined amount of current from or to the output current. In various embodiments, the circuit configured to receive the output current can include a filter, integrator and/or current-to-voltage converter that controls a predetermined voltage to a regulated circuit; a detector circuit configured to detect an excursion in another circuit; or an enable circuit configured to enable another circuit in response to the output current meeting one or more predetermined criteria.

The problem in FIGS. 1-2 relating to reference voltages to different ground potentials can be solved by first converting the regulated voltage and the reference voltage to current signals, and then operating (e.g., performing a linear operation, such as subtraction or addition, and then optionally performing a scaling operation) on the current signals using a current controlled current source, which in various embodiments can be as simple as a single common bipolar transistor or MOS field effect transistor (FET). Now, the output voltage to current conversion takes place with an effective voltage ratio of 1:1, and thus, the noise immunity is improved by 40×. Additional benefits of the present invention include a very small transconductance gain (e.g., it is relatively easy to obtain 33 nmhos using widely available CMOS and analog semiconductor manufacturing technologies), an intrinsic current comparator function, and a naturally high output impedance that can directly drive loop filter and additional control functions. These and other advantages of the present invention will become readily apparent from the detailed description of preferred embodiments below.

DETAILED DESCRIPTION

Reference will now be made in detail to various embodiments of the invention, examples of which are illustrated in the accompanying drawings. While the invention will be described in conjunction with the following embodiments, it will be understood that the descriptions are not intended to limit the invention to these embodiments. On the contrary, the invention is intended to cover alternatives, modifications and equivalents that may be included within the spirit and scope of the invention as defined by the appended claims. Furthermore, in the following detailed description, numerous specific details are set forth in order to provide a thorough understanding of the present invention. However, it will be readily apparent to one skilled in the art that the present invention may be practiced without these specific details. In other instances, well-known methods, procedures, components, and circuits have not been described in detail so as not to unnecessarily obscure aspects of the present invention.

For the sake of convenience and simplicity, the terms "connected to," "coupled with," "coupled to," and "in communication with," are generally used interchangeably herein, but are generally given their art-recognized meanings.

The present invention concerns a circuit and method for controlling a current source. The circuit generally includes a current source configured to receive a reference current, a bias voltage and a feedback current, the current source providing an output current; a regulated circuit, directly or indirectly receiving the output current and directly or indirectly providing the feedback current; and a current reference, configured to sink or source a predetermined amount of current from or to the output current. The method generally includes (a) applying a bias voltage to the current source, the current source receiving a feedback current and providing an output current; (b) sinking or sourcing a reference current from or to the output current; (c) applying the output of the current source to a regulated circuit; and (d) providing the feedback current from the regulated circuit.

The invention, in its various aspects, will be explained in greater detail below with regard to exemplary embodiments.

Exemplary Regulated Systems Using a Current-Controlled Current Source

Figure 3:
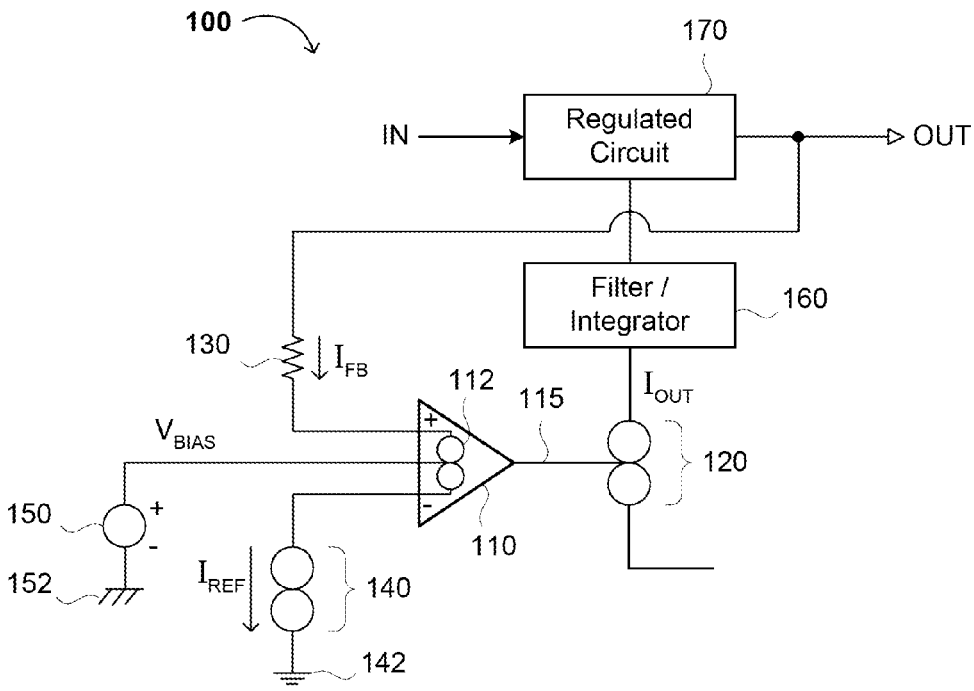
FIG. 3 is a first embodiment of a system employing the present current-controlled current source and a circuit having a voltage that is regulated by the present current-controlled current source.

FIG. 3 shows a first exemplary system 100 employing a current-controlled current source 110 and a circuit 170 having a voltage that is regulated by the current-controlled current source 110. The current-controlled current source 110 receives a feedback current $I_{FB}$ from the regulated circuit 170 (through a feedback resistor 130), a reference current from a current source 140, and a bias voltage from a bias source/generator 150. Generally, the bias voltage from the bias source/generator 150 biases the current-controlled current source 110. Also, the feedback "resistor" 130 may simply represent a resistance of a feedback path and/or of a circuit in the feedback path from the regulated circuit 170 to the current-controlled current source 110.

Thus, aspects of the current-controlled current source 110 relate to a circuit including a bias source and/or generator 150, a current reference 140 and a current source 112. The bias source and/or generator 150 is generally configured to provide a bias voltage (e.g., $V_{BIAS}$). The current reference 140 is generally configured to sink or source a predetermined amount of current (e.g., $I_{REF}$, which can be positive or negative). The current source 112 generally receives $I_{REF}$, the bias voltage and an input current (e.g., $I_{FB}$), and provides an output current (e.g., directly at 115, or indirectly, $I_{OUT}$). In various embodiments, the current source 112 is controlled by the bias voltage $V_{BIAS}$.

An output 115 of the current-controlled current source 110 is a current signal that represents the difference between the feedback current $I_{FB}$ and the reference current ($I_{REF}$) from the current source 140. The current signal 115 from the current-controlled current source 110 may control a second current source 120, which provides an output current $I_{OUT}$ that is converted to a voltage by the filter and/or integrator 160. In such a configuration, the second current source 120 may also receive an input current (not shown) from a conventional current source or a power rail (e.g., VCC or ground), either directly (generally in the case of a current source) or through a resistor (generally in the case of a power rail; also not shown). Alternatively, the current signal 115 may be input directly into the filter/integrator 160 or amplified by a known current amplification circuit.

The output current $I_{OUT}$ has a value equal to $A_I(I_{FB}-I_{REF})$, where $A_I$ is the gain of the second current source 120 or any current amplifier receiving the output 115 of the current-controlled current source 110. The filter/integrator 160 then outputs a voltage that is applied to the regulated circuit 170. Thus, the filter/integrator 160 can either include or be replaced with a current-to-voltage converter. The voltage from the filter/integrator 160 controls a voltage regulated in the regulated circuit 170, and as a result, can adjust itself to keep the output OUT in regulation.

The regulated circuit 170 can be any circuit (analog, digital, or mixed signal) that can use a feedback control system. In one example, the regulated circuit 170 is a switching regulator, a boost regulator, or a buck regulator. In other examples, the regulated circuit 170 can be an op amp, a pulse width modulator, a timing generator (e.g., a clock generator, such as a phase-locked loop or a voltage-controlled oscillator, or other periodic signal generator), a power amplifier (e.g., in a relatively high power/high voltage system, where the voltages generally are greater than or equal to 20V, 40V, or more), or a switch and/or driver for an LED lighting system, a display, an audio system, or a power conversion system. It is within the abilities of one skilled in the art to design such regulated circuits and use the present current controlled current source to regulate and/or control such regulated circuits. An output (e.g., OUT) of the regulated circuit 170 is fed back (through resistor 130) to the current-controlled current source 110 for comparison with the reference current from current source 140.

Figure 1:
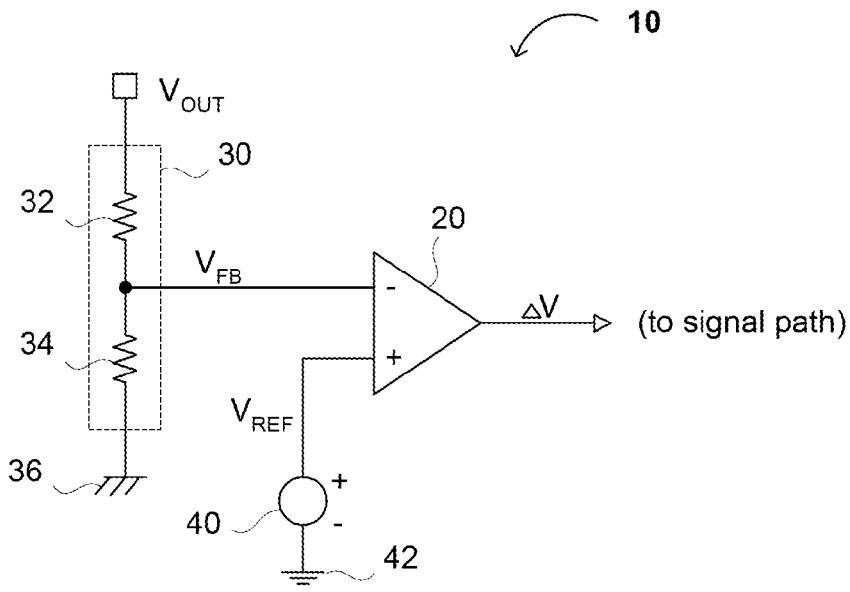
FIG. 1 is a schematic diagram showing a conventional op amp- or differential amplifier-based voltage regulator.
Figure 2:
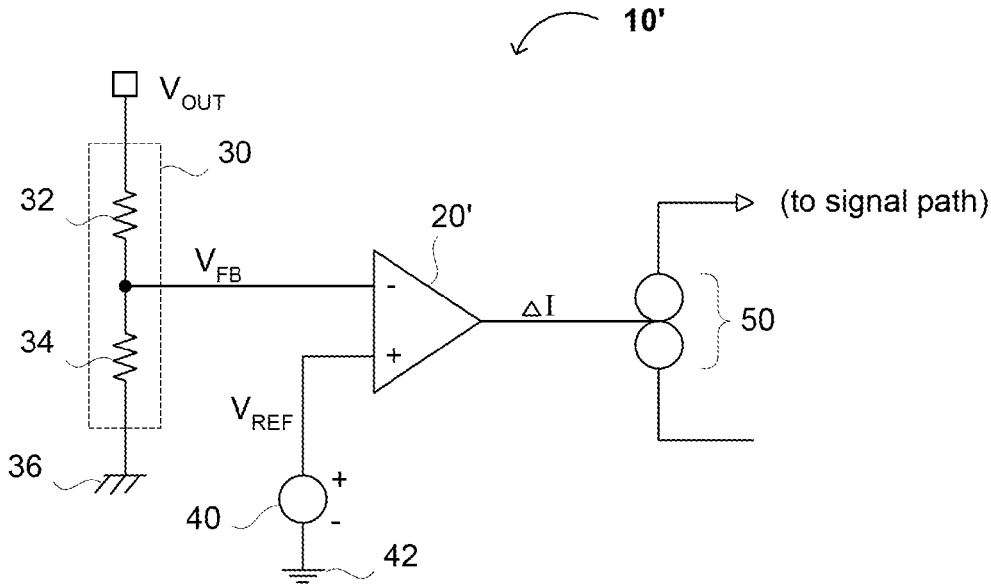
FIG. 2 is a schematic diagram showing a conventional voltage-controlled transconductance regulator.

Similar to the systems of FIGS. 1-2, the bias source/generator 150 can be coupled to a system ground potential 152 (e.g., external to the IC), whereas the current source 140 can be coupled to a reference potential 142 (e.g., internal to the IC). The voltage ($V_{OUT}$) of the signal output by the regulated circuit 170 has a value defined by the following Equation (4):

$$V_{OUT}=(I_{FB}\cdot R)+V_{BIAS}+\Delta GND \quad (4)$$

where R is the resistance of resistor 130 and $V_{bias}$ is the bias voltage from the bias source/generator 150.

When the ground potential 152 connected to the bias source/generator 150 is a system (or external) ground potential, $\Delta GND \neq 0$, and $dV_{OUT}/d\Delta GND=1$. Alternatively, when the ground potential 152 connected to the bias source/generator 150 is a reference (or internal) ground potential, $dV_{OUT}/d\Delta GND=0$, and the variation in the voltage applied to the regulated circuit 170 is independent of the gain of the regulator (i.e., the current-controlled current source feedback loop).

In an alternative embodiment, the ground potential 142 connected to the bias source/generator 140 can be a system ground potential, which can result in a $dV_{OUT}/d\Delta GND=0$, but such a configuration generally requires an extra or dedicated pin to connect the reference current generator 140 to a system ground potential. Because the reference current $I_{REF}$ is provided by the current source generator 140, the value of the ground potential 142 with respect to any other ground potential (e.g., ground potential 152) is irrelevant. However, the bias voltage source 150 generally requires connection to a ground potential (e.g., ground potential 152), which can either be an internal ground or external (system) ground. When the ground potential 152 is an internal ground, the sensitivity of the current-controlled current source 110 equals 1, and when the ground potential 152 is an external ground, the sensitivity of the current-controlled current source 110 equals 0 (when system ground is defined as the reference ground). Thus, the effect of ground noise and/or differences between different ground potentials in feedback-regulated voltages can be made independent of the gain of the system 100.

Figure 4:
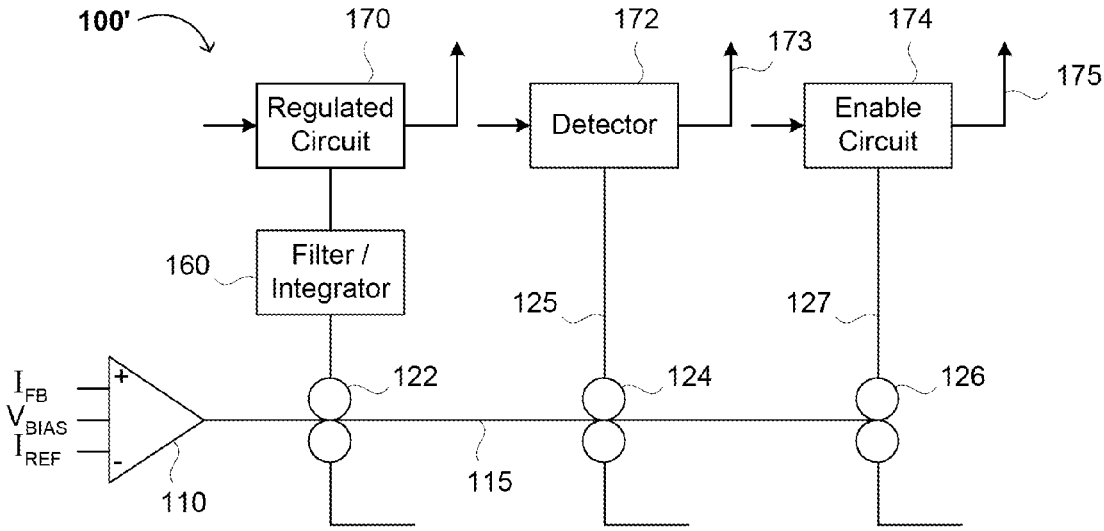
FIG. 4 is a further embodiment of a system employing the present current-controlled current source and a plurality of circuits using the current comparator function of the present current-controlled current source.

FIG. 4 shows a second exemplary system 100' employing the current-controlled current source 110 and a plurality of circuits 170, 172, 174 each having a voltage that is regulated by the present current-controlled current source 110. The current-controlled current source 110 is substantially the same as the current-controlled current source 110 of FIG. 3. However, the output 115 of current-controlled current source 110 can control multiple current sources 122, 124, 126, respectively providing a regulated current to a filter/integrator 160, a detector 172 and an enable circuit 174. Similarly to the embodiment shown in FIG. 3, the filter/integrator 160 provides a regulated voltage to the regulated circuit 170, which in turn provides a feedback signal to the current-controlled current source 110. Thus, the filter/integrator 160 and the regulated circuit 170 are part of a closed loop circuit.

As shown in FIG. 4, current sources 124 and 126 are in parallel with each other and with current source 122 and filter/integrator 160. Each of the detector 172 and enable circuit 174 receive a regulated current from the corresponding current sources 124 and 126, respectively, and can be part of an open loop circuit. Such "open loop" circuits generally include a current controlled current source (e.g., 110) configured to receive a bias voltage $V_{BIAS}$ and an input current (e.g., $I_{FB}$), a circuit configured to receive the output current 115 from the current controlled current source 110, a bias source and/or generator configured to provide the bias voltage $V_{BIAS}$; and a current reference configured to sink or source a predetermined amount of current (e.g., $I_{REF}$) from or to the output current. The detector 172 and enable circuit 174 may take advantage of the intrinsic current comparator function provided by the present current-controlled current source 110.

For example, the detector 172 can be configured to detect an excursion (e.g., in the regulated circuit 170 or elsewhere on the chip or in the system) above or below the regulated current at node 125 (or above or below a predetermined difference between the regulated current at node 125 and a reference current), and activate a control signal 173 that notifies the user of the excursion and/or that turns on, turns off, resets or adjusts (e.g., change an operational mode of) one or more circuits elsewhere on the chip or in the system. Alternatively, the current signal 125 can be converted to a voltage (e.g., using an analog-to-digital converter or a filter/integrator similar to filter/integrator 160), and the detector 172 can detect an excursion in such a voltage or voltage difference. In further embodiments, there can be more than one detector receiving the output 115 from the current-controlled current source 110.

Similarly, the enable circuit 174 can provide an active enable signal 175 enabling (e.g., turning on or activating) one or more circuits elsewhere on the chip or in the system in response to the regulated current at node 127 meeting one or more predetermined criteria (e.g., being above a first current value and/or below a second current value). Alternatively, the current signal 127 can be converted to a voltage similarly to the current signal 125, and the enable circuit 174 can provide an active enable signal 175 in response to the voltage meeting one or more predetermined criteria (e.g., being above a first voltage and/or below a second voltage). Thus, as a result of the intrinsic current comparator function provided by the current-controlled current source 110, functionality in addition to current/voltage regulation can be enabled on the chip and/or in the system.

More specifically, in various embodiments, a linear control loop including the filter/integrator 160 and the regulated circuit 170 can be controlled by the current-controlled current source 110 in a closed loop control system (e.g., the system 100 in FIG. 3). An open control loop including the current-controlled current source 110 and the detector 172 has at least two functions. The first function monitors the state of the current-controlled current source 110 and determines if the loop is within a regulation window (e.g., whether the loop has reached a steady state condition of regulation). In this case, the detector 172 may serve as a comparator with a predetermined margin (e.g., ±2%, ±5%, ±100 μOhms, ±0.1V, etc.) around a steady state target parameter value. So, the detector 172 (and the enable circuit 174) can operate in an open loop manner and generate a logic signal (e.g., output signal 173, 175).

However, the additional function blocks (e.g., the detector 172 and/or the enable circuit 174) can also operate in a non-linear closed loop control mode (e.g., using pulse frequency modulation [PFM]), whereby the linear loop path is open after the current source 124 or 126 (or, when present, an integrator receiving the output of the current source 124 or 126). The detector 172 or enable circuit 174 continues to monitor the state of the current-controlled current source 110, but the logic signal output by the detector 172 or enable circuit 174 controls the regulator loop (e.g., in a "bang-bang" fashion) around the regulation window (e.g., the predetermined margin).

The system 100' can improve the power efficiency of the system 100 and/or a chip containing the system 100 (FIG. 3), because the additional functions (e.g., detector 172 and/or enable circuit 174 in FIG. 4) require only a simple additional current reference source (e.g., current source 124 or 126) for each function. Additional comparators are not needed for the additional function blocks. As a result, capacitive loading on the feedback input $I_{FB}$ is reduced because the additional comparators that would normally be connected to this node for monitoring (e.g., similar to the current-controlled current source 110) are not present. Thus, the current controlled current source 110 can provide benefits to the system 100 for battery-powered applications (e.g., LED flashlights, mobile displays, etc.).

In fact, the additional functions shown in FIG. 4 can also be provided in a voltage-controlled current source (e.g., a transconductance amplifier-based system such as that shown in FIG. 2) by providing only an additional current source per detector function at the output of the transconductance amplifier, thereby reducing total area and power relative to a system that uses a separate transconductance amplifier for each function. Thus, in one embodiment, a transconductance amplifier can replace the current-controlled current source (CCCS) 110 in the system 100'.

Exemplary Current-Controlled Current Sources

Figure 5A:
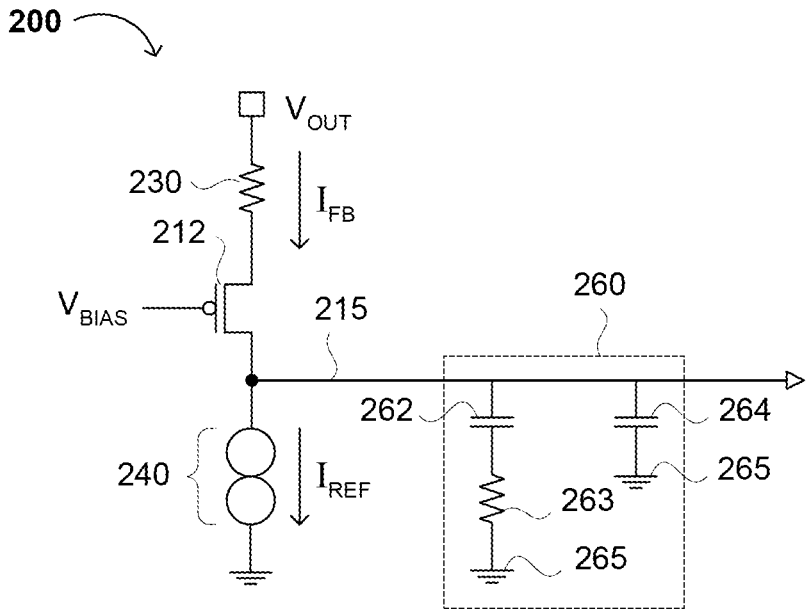
FIGS. 5A-5C are schematic diagrams showing various exemplary implementations of the present current-controlled current source.

In another aspect, the present invention relates to a current-controlled current source that includes, for example, a transistor configured to output a difference between a feedback current and a reference current, such as the exemplary circuit 200 of FIG. 5A. In various embodiments, the current controlled current source includes a transistor having a first terminal receiving the feedback (or input) current, a second terminal providing the output current, and a control terminal receiving a bias voltage.

The exemplary circuit 200 of FIG. 5A includes a PMOS transistor 212, a resistor 230, and a reference current source 240. A feedback current $I_{FB}$ is provided from the feedback voltage $V_{OUT}$ of the regulated circuit (not shown) across the resistor 230. The reference current source 240 provides a reference current $I_{REF}$ to or from an output node 215 of the current-controlled current source. The PMOS transistor 212 receives a bias voltage $V_{BIAS}$ at its gate, and is thus configured to output a current at node 215 that represents a difference between $I_{FB}$ and $I_{REF}$. The bias voltage $V_{BIAS}$ can be the bias voltage provided by the exemplary bias source/generator 150 of FIG. 3.

In the embodiment shown in FIG. 5A, the current output signal 215 is received directly at a loop filter or integrator 260. The loop filter/integrator 260 includes first and second capacitors 262 and 264 and resistor 263. As shown in FIG. 5A, the first capacitor 262 and the resistor 263 are in series between a node 215 and a ground potential (e.g., reference ground 265), and the second capacitor 264 is in parallel with the first capacitor 262 and the resistor 263. The loop filter/integrator 260 is configured to store charge from the current output signal 215, convert the current output signal 215 to a voltage signal within a particular time domain (e.g., of the system 100 in FIG. 3, in which the regulated circuit may provide an output having a periodic waveform, such as a square wave or a sawtooth/triangular wave having a duty cycle, e.g., of from 40-60%), and/or drive the current difference at node 215 (e.g., $I_{FB}-I_{REF}$) to zero.

In a further embodiment (e.g., similar to the system 100 of FIG. 3), a variable current source can be placed between the output node 215 and the loop filter 260. In an alternative embodiment, the loop filter 260 can be placed between the transistor 212 and a variable current source (e.g., 120 in FIG. 3). Also, the loop filter/integrator 260 can be replaced with a linear regulator or an RL filter (e.g., comprising a resistor and an inductor, each receiving the output current at node 215) configured to maintain the output current in the current domain before further processing by downstream circuitry (e.g., the detector 172 and/or enable circuit 174 in FIG. 4).

Figure 5B:
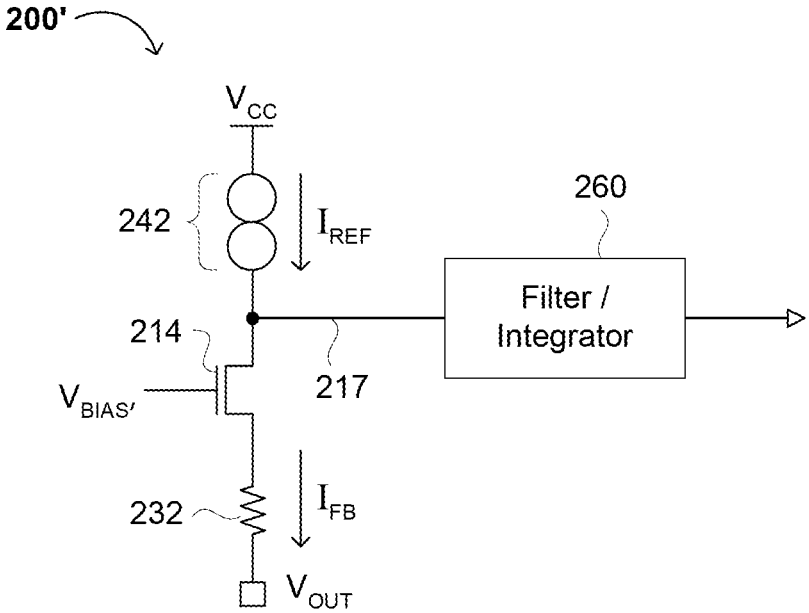

A further embodiment of the present current-controlled current source is shown in FIG. 5B. The current-controlled current source 200' is essentially a complementary version of the current-controlled current source 200 of FIG. 5A. The current-controlled current source 200' of FIG. 5B includes an NMOS transistor 214, a resistor 232, and a reference current source 242. The feedback current $I_{FB}$ is sunk by the feedback voltage $V_{OUT}$ of the regulated circuit (not shown), across the resistor 232. The reference current source 240 sources a reference current $I_{REF}$ from an upper power supply $V_{CC}$. The NMOS transistor 214 receives a bias voltage $V_{BIAS}'$ at its gate, similar (but complementary) to the bias voltage $V_{BIAS}$ at the gate of PMOS transistor 212 (FIG. 5A). The NMOS transistor 214 (FIG. 5B) is thus configured to output a current at node 215 that represents a difference between $I_{FB}$ and $I_{REF}$ (e.g., $I_{REF}-I_{FB}$).

The current output signal 217 is received directly at a loop filter or integrator 260 similar to the loop filter/integrator 260 of FIG. 5A. In further embodiments, a variable current source can be placed between the output node 217 and the loop filter 260, and the loop filter/integrator 260 can be replaced with a linear regulator.

Figure 5C:
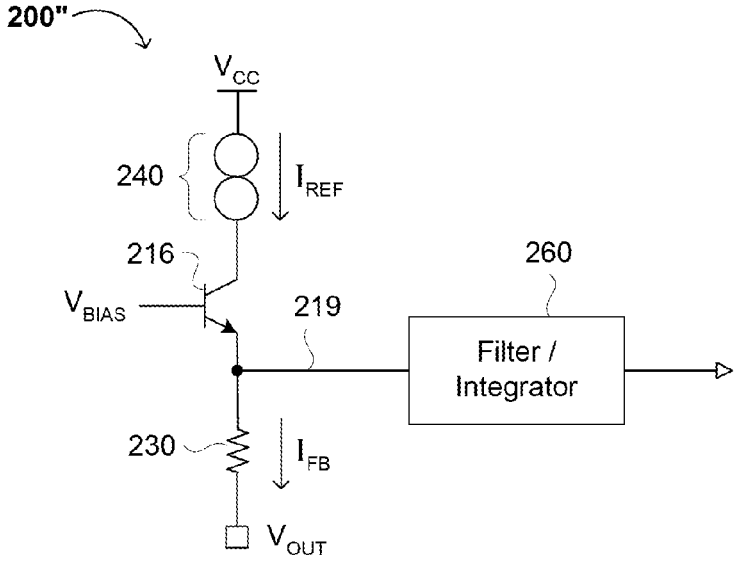

A still further embodiment of the present current-controlled current source is shown in FIG. 5C. The current-controlled current source 200" of FIG. 5C includes an NPN bipolar junction transistor 216, a resistor 230, and a reference current source 240. The resistor 230 and reference current source 240 can be substantially the same as those shown in FIG. 5A. In the current-controlled current source 200" of FIG. 5C, the feedback current $I_{FB}$ is provided from the feedback voltage $V_{OUT}$ of the regulated circuit (not shown) across the resistor 230. The reference current source 240 sinks a reference current $I_{REF}$ from an output node 215 of the current-controlled current source. The NPN bipolar junction transistor 216 receives a bias voltage $V_{BIAS}$ at its base, and is thus configured to output a current at node 219 that represents a difference between $I_{FB}$ and $I_{REF}$ (e.g., $I_{FB}-I_{REF}$). The bias voltage $V_{BIAS}$ can be the bias voltage provided by the exemplary bias source/generator 150 of FIG. 3. The current-controlled current source 200" of FIG. 5C outputs a current difference signal 219 that is generally not affected by a threshold voltage of the transistor and that has a gain that may have a larger linear range as a function of the bias voltage $V_{BIAS}$ and/or the difference between $I_{FB}$ and $I_{REF}$.

Like the current-controlled current sources 200 and 200' of FIGS. 5A-B, the current output signal 219 from the current-controlled current source 200" of FIG. 5C is received directly at a loop filter or integrator 260, and in further embodiments, a variable current source can be placed between the output node 217 and the loop filter 260, and/or the loop filter/integrator 260 can be replaced with a linear regulator.

An Exemplary Method

Figure 6:
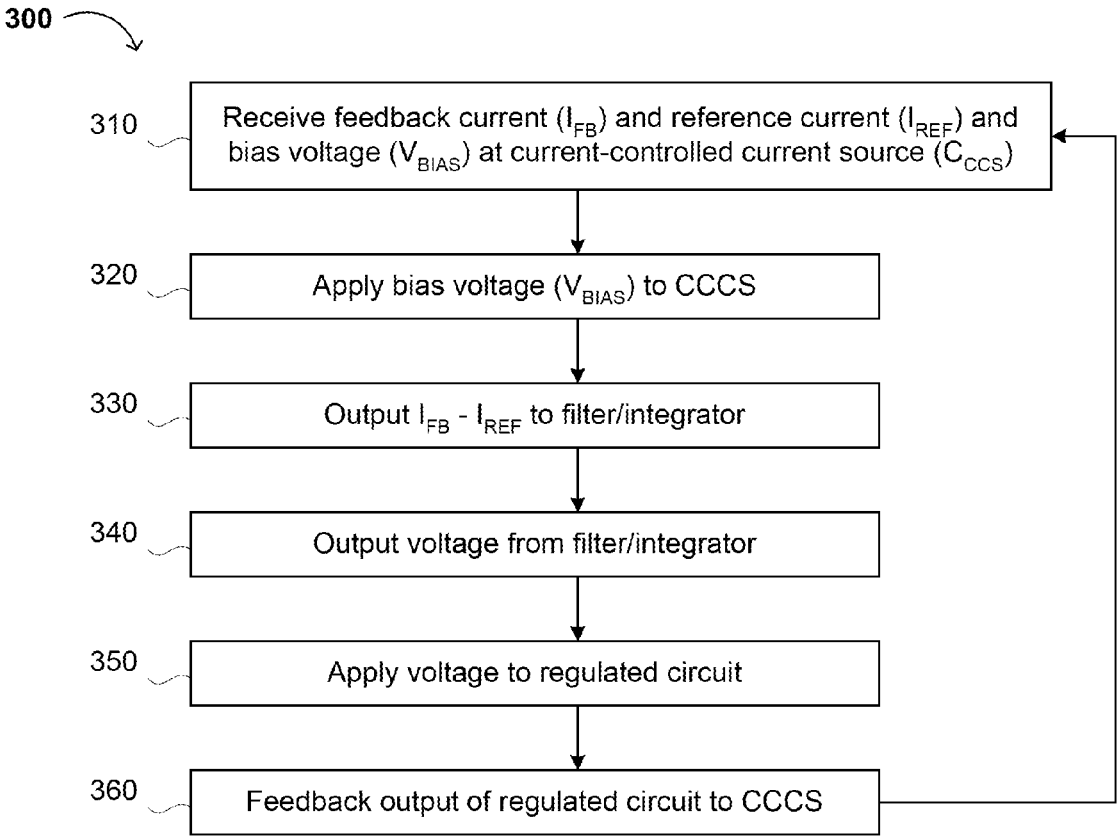
FIG. 6 is a flow diagram of an exemplary method of controlling or regulating a voltage in a circuit using the present current-controlled current source.

The present invention further relates to method of regulating or controlling a current and/or voltage in a circuit using a current-controlled current source. In general, a bias voltage is applied to the current-controlled current source, and a reference current is sunk from or sourced to the current output by the current-controlled current source. The output current generally represents a difference between a current input to the current-controlled current source and the reference current. The output current is then applied directly or indirectly to a regulated circuit. A flow chart 300 for an exemplary method of regulating or controlling a current and/or voltage in a circuit is shown in FIG. 6.

At 310, and as discussed above, the current-controlled current source (CCCS) receives a feedback current ($I_{FB}$), a reference current ($I_{REF}$) and a bias voltage ($V_{BIAS}$). In various embodiments, and as a discussed above (e.g., with regard to FIGS. 5A-5C), the CCCS can include a transistor configured to receive the feedback current from the circuit regulated by the present method at a first terminal (e.g., a source or drain) of the transistor and the reference current at a second terminal (e.g., the other of the source or drain) of the transistor. As shown in 320 of FIG. 6, the bias voltage is applied to the CCCS, generally at the gate or base of the transistor in transistor-based embodiments. Typically, the feedback current is generated by applying a feedback voltage from the regulated circuit to an input of a feedback resistor coupled to the first terminal of the transistor. The reference current can be generated by a conventional fixed current source, and the bias voltage can be generated by a conventional fixed bias or voltage generator. Appropriate values of the reference current and the bias voltage can be determined by those skilled in the art without undue experimentation.

As a result, at 330, the current difference $I_{FB}-I_{REF}$ is output from the CCCS to a filter/integrator. The current difference $I_{FB}-I_{REF}$ is generally a regulated current, which can be used for various purposes as a result of the intrinsic current comparator function provided by the CCCS. For example, the regulated current can be used to detect an excursion in the regulated circuit (or elsewhere on the chip or in the system) above or below the regulated current (or a regulated voltage corresponding thereto). Also, the regulated current can be used to enable or activate one or more circuits elsewhere on the chip or in the system in response to the regulated current meeting one or more predetermined criteria. In various embodiments, the filter/integrator is the same as or similar to loop filter 260 in FIG. 5A.

As discussed elsewhere herein, the filter/integrator converts the current difference $I_{FB}-I_{REF}$ to a (regulated) voltage, and at 340, the (regulated) voltage is output from the filter/integrator to the regulated (or voltage-controlled) circuit. As described elsewhere herein, the regulated circuit can be any circuit that uses a feedback control system, such as a switching regulator, an op amp, a pulse width modulator, a timing generator or other periodic signal generator, a power amplifier, a switch and/or driver for an LED or other lighting or display system, an audio system, or a power conversion system.

At 360, an output of the regulated circuit is then fed back to the CCCS. In various embodiments, an output voltage is fed through a resistor (or other voltage-to-current converter) to generate a feedback current (e.g., $I_{FB}$). The feedback current is then received by the CCCS at 310, thereby completing the loop.

CONCLUSION/SUMMARY

The present invention provides circuits and methods for controlling a current source. In one aspect (e.g., "closed loop" embodiments), the circuit generally includes a current source configured to receive a reference current, a bias voltage and a feedback current, the current source providing an output current; a regulated circuit, directly or indirectly receiving the output current and directly or indirectly providing the feedback current; and a current reference, configured to sink or source a predetermined amount of current from or to the output current. Another aspect of the invention involves a circuit (e.g., for implementing a current-controlled current source) that includes a bias source and/or generator configured to provide a bias voltage; a current reference configured to sink or source a predetermined amount of current; and a current source configured to receive the predetermined amount of current, the bias voltage and an input current, the current source providing an output current representing a difference between the input current and the predetermined amount of current. Yet another aspect of the invention (e.g., "open loop" embodiments) involves a circuit that includes a current controlled current source configured to receive a bias voltage and an input current, the current controlled current source providing an output current; a circuit configured to receive the output current; a bias source and/or generator configured to provide the bias voltage; and a current reference, configured to sink or source a predetermined amount of current from or to the output current. The method generally includes (a) applying a bias voltage to the current source, the current source receiving an input current and providing an output current; (b) sinking or sourcing a reference current from or to the output current, the output current representing a difference between an input current to the current source and the reference current; and (c) applying the output current to a regulated circuit.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A circuit, comprising:

a) a current source configured to receive a reference current, a bias voltage and a feedback current, the current source providing an output current;

b) a regulated circuit, directly or indirectly receiving the output current and directly or indirectly providing the feedback current; and c) a current reference, configured to sink or source a predetermined amount of current from or to the output current.

2. The circuit of claim 1, wherein the current source comprises a transistor.

3. The circuit of claim 2, wherein the transistor comprises a MOS transistor having a gate receiving the bias voltage, a first source/drain terminal receiving the feedback current, and a second source/drain terminal outputting the output current.

4. The circuit of claim 1, further comprising a filter, an integrator and/or a current-to-voltage converter receiving the output current and providing a predetermined voltage to the regulated circuit.

5. The circuit of claim 4, wherein the filter, integrator and/or current-to-voltage converter comprises a RC circuit.

6. The circuit of claim 5, wherein the RC circuit comprises a first capacitor receiving the output current at a first electrode, and a first resistor coupled to a second electrode of the first capacitor.

7. The circuit of claim 6, wherein the first resistor is also coupled to a power terminal.

8. The circuit of claim 1, further comprising a feedback resistor receiving a feedback voltage from the regulated circuit and providing the feedback current to the current source.

9. The circuit of claim 1, wherein the regulated circuit comprises an LED control circuit, a power amplifier, an audio amplifier, an operational amplifier, an automatic gain control circuit, or a display driver.

10. The circuit of claim 1, wherein the current source is configured to provide the output current to a second circuit.

11. The circuit of claim 10, wherein the second circuit comprises a detector circuit or an enable circuit.

12. A circuit, comprising:

a) a bias source and/or generator configured to provide a bias voltage;

b) a current reference configured to sink or source a predetermined amount of current; and c) a current source configured to receive the predetermined amount of current, the bias voltage and an input current, the current source providing an output current representing a difference between the input current and the predetermined amount of current, the input current being provided by a regulated circuit that directly or indirectly receives the output current.

13. The circuit of claim 12, wherein the current source is controlled by the bias voltage.

14. The circuit of claim 13, wherein the current source comprises a transistor having a first terminal receiving the input current, a second terminal providing the output current, and a control terminal receiving the bias voltage.

15. A circuit, comprising:

a) a current controlled current source configured to receive a bias voltage and an input current, the current controlled current source providing an output current;

b) a first circuit configured to directly or indirectly receive the output current and provide the input current to the current controlled current source;

c) a bias source and/or generator configured to provide the bias voltage; and d) a current reference, configured to sink or source a predetermined amount of current from or to the output current.

16. The circuit of claim 15, wherein the first circuit comprises a filter, integrator and/or current-to-voltage converter receiving the output current and controlling a predetermined voltage to a regulated circuit; a detector circuit configured to detect an excursion in a second circuit; or an enable circuit configured to enable another circuit in response to the output current meeting one or more predetermined criteria.

17. The circuit of claim 16, wherein said first circuit further comprises a feedback resistance receiving a feedback voltage from the regulated circuit and providing the input current to the current controlled current source.

18. A method of controlling a current source, comprising:

a) applying a bias voltage to the current source, the current source receiving an input current and providing an output current representing a difference between the input current and a reference current;

b) sourcing or sinking the reference current to or from the output current, wherein the output current represents a difference between the input current and the reference current; and c) applying the output current directly or indirectly to a regulated circuit configured to provide the input current.

19. The method of claim 18, further comprising converting the output current to control a predetermined voltage in or to the regulated circuit.

20. The method of claim 18, wherein the regulated circuit provides an output voltage, the input current comprises a feedback current, and the method further comprises converting the output voltage to the feedback current, and providing the feedback current from the regulated circuit to the current source.

* * * * *